US008824937B2

(12) United States Patent
Matsui

(10) Patent No.: US 8,824,937 B2
(45) Date of Patent: Sep. 2, 2014

(54) DEVELOPING DEVICE AND IMAGE FORMING APPARATUS WITH LAYER THICKNESS RESTRICTING MEMBER TO RESTRICT THICKNESS OF DEVELOPER ON MAGNETIC ROLLER

(75) Inventor: Kenshi Matsui, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/609,401

(22) Filed: Sep. 11, 2012

(65) Prior Publication Data

US 2013/0071146 A1 Mar. 21, 2013

(30) Foreign Application Priority Data

Sep. 15, 2011 (JP) ..... 2011-202077

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01)
USPC ..... 399/272; 399/274

(58) Field of Classification Search
CPC ..... G03G 15/081
USPC ..... 399/272, 274
See application file for complete search history.

(56) References Cited

U.S. PATENT DOCUMENTS 4,636,057 A * 1/1987 Iida et al. ..... 399/214
4,666,285 A * 5/1987 Iida et al. ..... 399/214
4,714,338 A * 12/1987 Iida et al. ..... 399/70
5,239,345 A * 8/1993 Kikuchi et al. ..... 399/236
8,369,750 B2 * 2/2013 Itagaki et al. ..... 399/252
2004/0190948 A1 9/2004 Sano et al.
2005/0084283 A1 * 4/2005 Choi et al. ..... 399/103
2007/0025777 A1 * 2/2007 Tomita et al. ..... 399/274
2009/0041506 A1 * 2/2009 Akedo ..... 399/254
2009/0304415 A1 * 12/2009 Okada et al. ..... 399/281
2011/0052270 A1 * 3/2011 Gyoutoku et al. ..... 399/273
2011/0064454 A1 * 3/2011 Xu et al. ..... 399/103
2012/0003015 A1 * 1/2012 Brown ..... 399/273
2013/0071145 A1 * 3/2013 Toichi ..... 399/267
2013/0164045 A1 * 6/2013 Onoda et al. ..... 399/274
2013/0209142 A1 * 8/2013 Kusukawa et al. ..... 399/274

FOREIGN PATENT DOCUMENTS

JP 60-205472 10/1985
JP 2001290366 10/2001
JP 2007-322707 12/2007
JP 2009-115845 5/2009

* cited by examiner

*Primary Examiner* — G. M. Hyder
(74) *Attorney, Agent, or Firm* — Gerald E. Hespos; Michael J. Porco; Matthew T. Hespos

(57) ABSTRACT

A developing device includes a case for housing a developer, a magnetic roller, an agitating member, a layer thickness restricting member, an auxiliary developer storing portion and a plate-like flexible member. The magnetic roller includes a rotary shaft and magnetically carries the developer on a circumferential surface. The agitating member includes a shaft center and a screw forming portion arranged around the shaft center and agitates and conveys the developer while rotating. The layer thickness restricting member restricts the layer thickness of the developer to a predetermined thickness. The auxiliary developer storing portion faces the circumferential surface of the magnetic roller at a side upstream of the layer thickness restricting member in a rotating direction of the magnetic roller. The plate-like flexible member extends toward the circumferential surface of the magnetic roller and forms a wall surface on an upstream side of the auxiliary developer storing portion.

11 Claims, 6 Drawing Sheets

DEVELOPING DEVICE AND IMAGE FORMING APPARATUS WITH LAYER THICKNESS RESTRICTING MEMBER TO RESTRICT THICKNESS OF DEVELOPER ON MAGNETIC ROLLER

INCORPORATION BY REFERENCE

This application is based on Japanese Patent Application Serial No. 2011-202077 filed with the Japan Patent Office on Sep. 15, 2011, the contents of which are hereby incorporated by reference.

BACKGROUND

The present disclosure relates to a developing device used in an image forming apparatus such as a printer and particularly to a developing device adopting a two-component developer containing a carrier and a toner and an image forming apparatus provided with the same.

Conventionally, a developing device as described below is known as a developing device used in an image forming apparatus such as a printer. Such a developing device is formed by housing a screw feeder (agitating member), a magnetic roller and a layer thickness restricting member in a development housing. The screw feeder agitates a developer by rotating about a shaft center. The magnetic roller is arranged parallel to this screw feeder and supplies a toner fed from the screw feeder to the circumferential surface of a photoconductive drum by rotating about a shaft center. The layer thickness restricting member extends in an axial center direction of the magnetic roller and restricts the amount of the developer on the magnetic roller. A leading edge part of the layer thickness restricting member faces the circumferential surface of the magnetic roller.

Here, by rotating the screw feeder about the shaft center, the developer loaded in a case is moved upward while being agitated, and compressed through a clearance between a compressing member arranged to face the screw feeder and the screw feeder (hereinafter, referred to as a developer compressing clearance). Thereafter, this developer passes between the layer thickness restricting member and the magnetic roller and is supplied to the circumferential surface of the magnetic roller in a state set to a predetermined thickness. Since the developer is smoothly fed toward the layer thickness restricting member while being kept in a compressed state by the presence of this developer compressing clearance, there is no such inconvenience that the developer moves toward the layer thickness restricting member in an insufficiently compressed state.

The above effect is achieved by the conventional technology under such a condition that the amount of the developer in the development housing is relatively small and the developer separated from the magnetic roller and having fallen down is conveyed upward again after slipping under the screw feeder since the developer can pass through the developer compressing clearance. However, if the amount of the developer in the development housing is relatively large, the following problem occurs. That is, if the developer is stored in the development housing to such a degree as to cover an area above the screw feeder, the developer separated from the magnetic roller and having fallen down cannot slip under the screw feeder after passing a developing portion in which the developer is supplied toward the photoconductive drum. Thus, the developer that has fallen, triggered by the operation of the screw feeder, may adhere to the magnetic roller again. Since a toner/carrier ratio differs between the fallen developer and the developer in the development housing, a toner density distribution is produced on the magnetic roller, with the result that the density of an image formed on a sheet may vary. In such a case, the separated developer cannot pass through the developer compressing clearance with the conventional technology, wherefore it is difficult to solve a variation of toner density on the magnetic roller.

The present disclosure was developed to solve the problem as described above and an object thereof is particularly to solve a variation of toner density on a magnetic roller of a developing device.

SUMMARY

A developing device according to one aspect of the present disclosure includes a case for housing a developer, a magnetic roller, an agitating member, a layer thickness restricting member, an auxiliary developer storing portion and a plate-like flexible member. The magnetic roller is arranged in the case, includes a rotary shaft and magnetically carries the developer on a circumferential surface by rotating about the rotary shaft. The agitating member is arranged to face the magnetic roller in the case, includes a shaft center and a screw forming portion arranged around the shaft center and agitates and conveys the developer while rotating. The layer thickness restricting member is arranged to face the magnetic roller and restricts the layer thickness of the developer supplied from the agitating member to the magnetic roller to a predetermined thickness. The auxiliary developer storing portion is arranged along a rotation axis direction of the magnetic roller to face the circumferential surface of the magnetic roller at a side upstream of the layer thickness restricting member in a rotating direction of the magnetic roller. The plate-like flexible member extends toward the circumferential surface of the magnetic roller and forms a wall surface on an upstream side of the auxiliary developer storing portion in the rotating direction of the magnetic roller.

An image forming apparatus according to another aspect of the present disclosure includes an image bearing member and the above developing device. An electrostatic latent image is formed on a surface of the image bearing member and developed into a developer image by a developer supplied from the magnetic roller.

These and other objects, features and advantages of the present disclosure will become more apparent upon reading the following detailed description along with the accompanying drawings.

DETAILED DESCRIPTION

Figure 1:
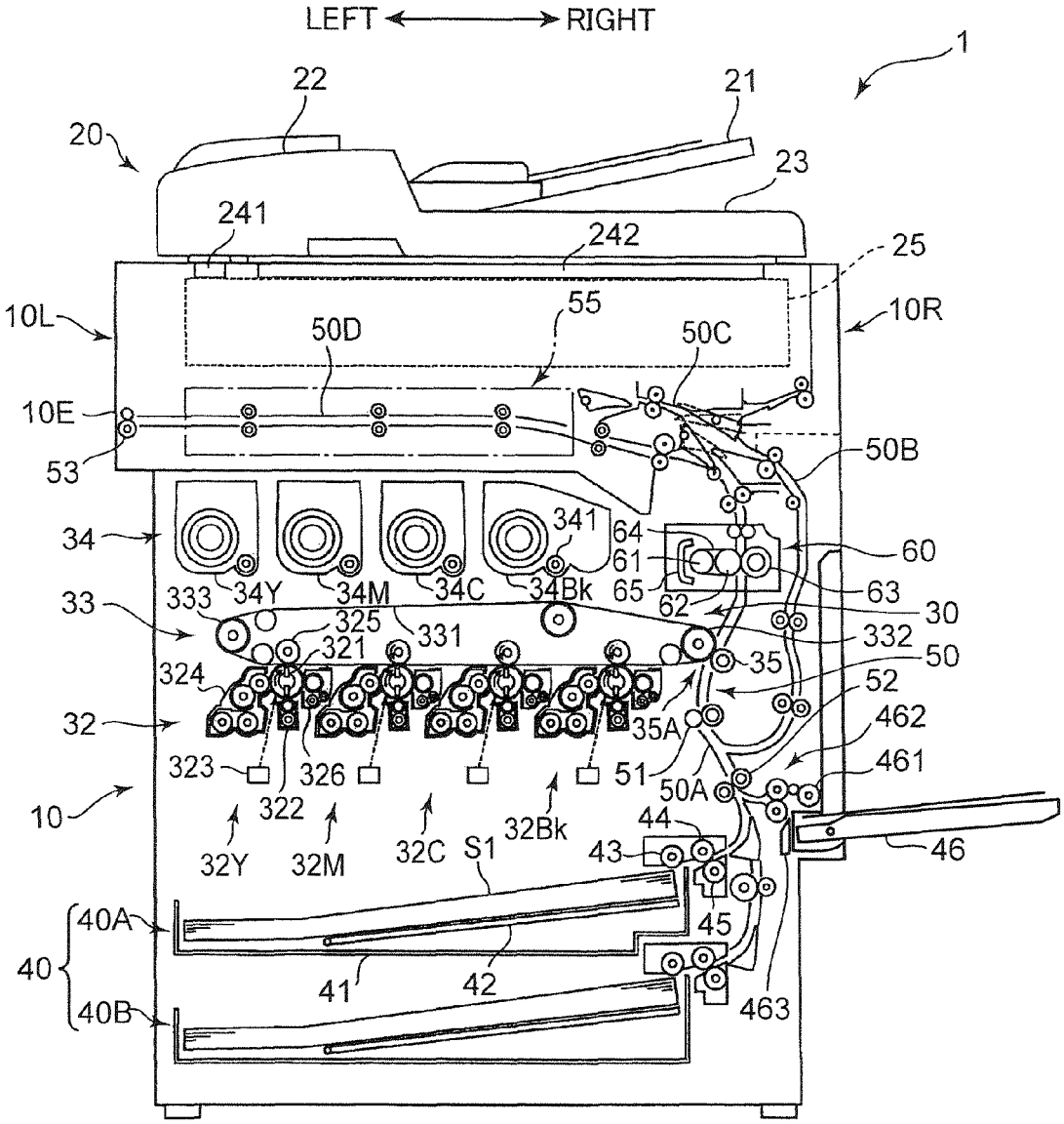
FIG. 1 is a sectional view showing the internal structure of an image forming apparatus according to one embodiment of the present disclosure.

Hereinafter, an embodiment of the present disclosure is described based on the drawings. FIG. 1 is a sectional view showing the internal structure of an image forming apparatus 1 according to one embodiment of the present disclosure. Although a complex machine provided with a printer function and a copier function is illustrated as the image forming apparatus 1 here, the image forming apparatus may be a printer, a copier or a facsimile machine.

The image forming apparatus 1 includes an apparatus main body 10 having a substantially rectangular parallelepipedic case structure, an auto document feeder 20 arranged atop the apparatus main body 10 and a manual feed tray 46 attached to a lower part of a right side surface 10R of the apparatus main body 10. In the apparatus main body 10 are housed a reading unit 25 for optically reading a document image to be copied, an image forming station 30 for forming a toner image on a sheet, a fixing unit 60 for fixing the toner image to the sheet, a sheet feeding unit 40 for storing standard size sheets to be conveyed to the image forming station 30, a conveyance route 50 in which a standard size sheet is conveyed from the sheet feeding unit 40 or the manual feed tray 46 to a sheet discharge opening 10E via the image forming station 30 and the fixing unit 60, and a conveying unit 55 internally including a sheet conveyance path forming a part of this conveyance route 50.

The auto document feeder (ADF) 20 is rotatably mounted on the upper surface of the apparatus main body 10. The ADF 20 automatically feeds a document sheet to be copied to a predetermined document reading position (position where a first contact glass 241 is mounted) in the apparatus main body 10. On the other hand, when a user manually places a document sheet at a predetermined document reading position (position where a second contact glass 242 is arranged), the ADF 20 is opened upward. The ADF 20 includes a document tray 21 on which document sheets are to be placed, a document conveying unit 22 for conveying a document sheet via the automatic document reading position and a document discharge tray 23 to which the read document sheet is to be discharged.

The reading unit 25 optically reads an image of a document sheet via the first contact glass 241 for reading a document sheet automatically fed from the ADF 20 on the upper surface of the apparatus main body 10 or the second contact glass 242 for reading a manually placed document sheet. A scanning mechanism including a light source, a moving carriage, a reflecting mirror and the like and an imaging element are housed in the reading unit 25 (not shown). The scanning mechanism irradiates light to a document sheet and guides light reflected by the document sheet to the imaging element. The imaging element photoelectrically converts the reflected light into an analog electrical signal. The analog electrical signal is input to the image forming station 30 after being converted into a digital electrical signal in an A/D conversion circuit.

The image forming station 30 performs a process of generating a full-color toner image and transferring it to a sheet and includes an image forming unit 32 with four units 32Y, 32M, 32C and 32Bk arranged in a tandem manner for forming a toner image of each of yellow (Y), magenta (M), cyan (C) and black (Bk), an intermediate transfer unit 33 arranged above and adjacent to the image forming unit 32, and a toner supply unit 34 arranged above the intermediate transfer unit 33.

Each of the image forming units 32Y, 32M, 32C and 32Bk includes a photoconductive drum 321 (image bearing member), and a charger 322, an exposure device 323, a developing device 324, a primary transfer roller 325 and a cleaning device 326 arranged around this photoconductive drum 321.

The photoconductive drum 321 is rotated about its shaft and an electrostatic latent image and a toner image are formed on the circumferential surface thereof. A photoconductive drum made of an amorphous silicon (a-Si) material can be used as the photoconductive drum 321. The charger 322 uniformly charges the surface of the photoconductive drum 321. The exposure device 323 includes optical components such as a laser light source, a mirror and a lens and irradiates the circumferential surface of the photoconductive drum 321 with light based on image data of a document image, thereby forming an electrostatic latent image.

The developing device 324 supplies a toner to the circumferential surface of the photoconductive drum 321 to develop an electrostatic latent image formed on the photoconductive drum 321. The developing device 324 is for a two-component developer and includes screw feeders 85, 86, a magnetic roller 82 and a developing roller 83. This developing device 324 is described in detail later.

The primary transfer roller 325 forms a nip portion together with the photoconductive drum 321 with an intermediate transfer belt 331 of the intermediate transfer unit 33 sandwiched therebetween and primarily transfers a toner image on the photoconductive drum 321 to the intermediate transfer belt 331. The cleaning device 326 includes a cleaning roller and the like and cleans the circumferential surface of the photoconductive drum 321 after the transfer of the toner image.

The intermediate transfer unit 33 includes the intermediate transfer belt 331, a drive roller 332 and a driven roller 333. The intermediate transfer belt 331 is an endless belt mounted between the drive roller 332 and the driven roller 333 and toner images from a plurality of photoconductive drums 321 are transferred in a superimposition manner at the same position on the outer circumferential surface of the intermediate transfer belt 331 (so-called primary transfer).

A secondary transfer roller 35 is arranged to face the circumferential surface of the drive roller 332. A nip portion between the drive roller 332 and the secondary transfer roller 35 serves a secondary transfer portion 35A for transferring a full-color toner image formed by the toner images transferred in a superimposition manner to the intermediate transfer belt 331 to a sheet. A secondary transfer bias having a polarity opposite to that of the toner image is applied to either one of the drive roller 332 and the secondary transfer roller 35, whereas the other roller is grounded.

The toner supply unit 34 includes a yellow toner container 34Y, a magenta toner container 34M, a cyan toner container 34C and a black toner container 34Bk. These toner containers 34Y, 34C, 34M and 34Bk are respectively for storing toners of the respective colors and supply the toners of the respective colors to the developing devices 321 of the image forming units 32Y, 32M, 32C and 32Bk corresponding to the respective YMCBk colors via unillustrated supply paths. Each of the toner containers 34Y, 34C, 34M and 34Bk includes a conveying screw 341 for conveying the toner in the container to an unillustrated toner discharge opening. This conveying screw 341 is driven and rotated by a driver (not shown), whereby the toner is supplied into the developing device 324.

The sheet feeding unit 40 includes sheet cassettes 40A, 40B arranged in two levels for storing sheets S1 out of sheets to which an image forming process is applied. These sheet cassettes 40A, 40B can be pulled out forward from the front side of the apparatus main body 10.

The sheet cassette 40A (40B) includes a sheet storing portion 41 for storing a sheet stack formed by stacking the sheets S1 one over another and a lift plate 42 for lifting up the sheet stack for sheet feeding. A pickup roller 43 and a roller pair composed of a feed roller 44 and a retard roller 45 are arranged above the right end of the sheet cassette 40A (40B).

By driving the pickup roller 43 and the feed roller 44, the uppermost sheet S1 of the sheet stack in the sheet cassette 40A is fed one by one and conveyed into an upstream end of the conveyance route 50.

The manual feed tray 46 is provided at the right side surface 10R of the apparatus main body 10. The manual feed tray 46 is attached to the apparatus main body 10 openably and closably about a lower end part thereof. The user opens the manual feed tray 46 as shown and places a sheet thereon in the case of manual feeding. The sheet placed on the manual feed tray 46 is conveyed into the conveyance route 50 by driving a pickup roller 461 and a feed roller 462.

The conveyance route 50 includes a main conveyance path 50A for conveying a sheet from the sheet feeding unit 40 to the exit of the fixing unit 60 via the image forming station 30, a reversing conveyance path 50B for returning a sheet having one side printed to the image forming station 30 in the case of printing both sides of the sheet, a switchback conveyance path 50C for conveying a sheet from a downstream end of the main conveyance path 50A to an upstream end of the reversing conveyance path 50B, and a horizontal conveyance path 50D for horizontally conveying a sheet from the downstream end of the main conveyance path 50A to the sheet discharge opening 10E provided in a left side surface 10L of the apparatus main body 10. This horizontal conveyance path 50D is mostly formed by the sheet conveyance path provided in the conveying unit 55.

The fixing unit 60 is an induction heating type fixing device for applying a fixing process of fixing a toner image to a sheet and includes a heating roller 61, a fixing roller 62, a pressure roller 63, a fixing belt 64 and an induction heating unit 65. The pressure roller 63 is pressed into contact with the fixing roller 62 to form a fixing nip portion. The heating roller and the fixing belt 64 are induction-heated by the induction heating unit 65 to give that heat to the fixing nip portion. A sheet passes through the fixing nip portion, whereby a toner image transferred to the sheet is fixed to the sheet.

<Configuration of Developing Device>

Figure 2:
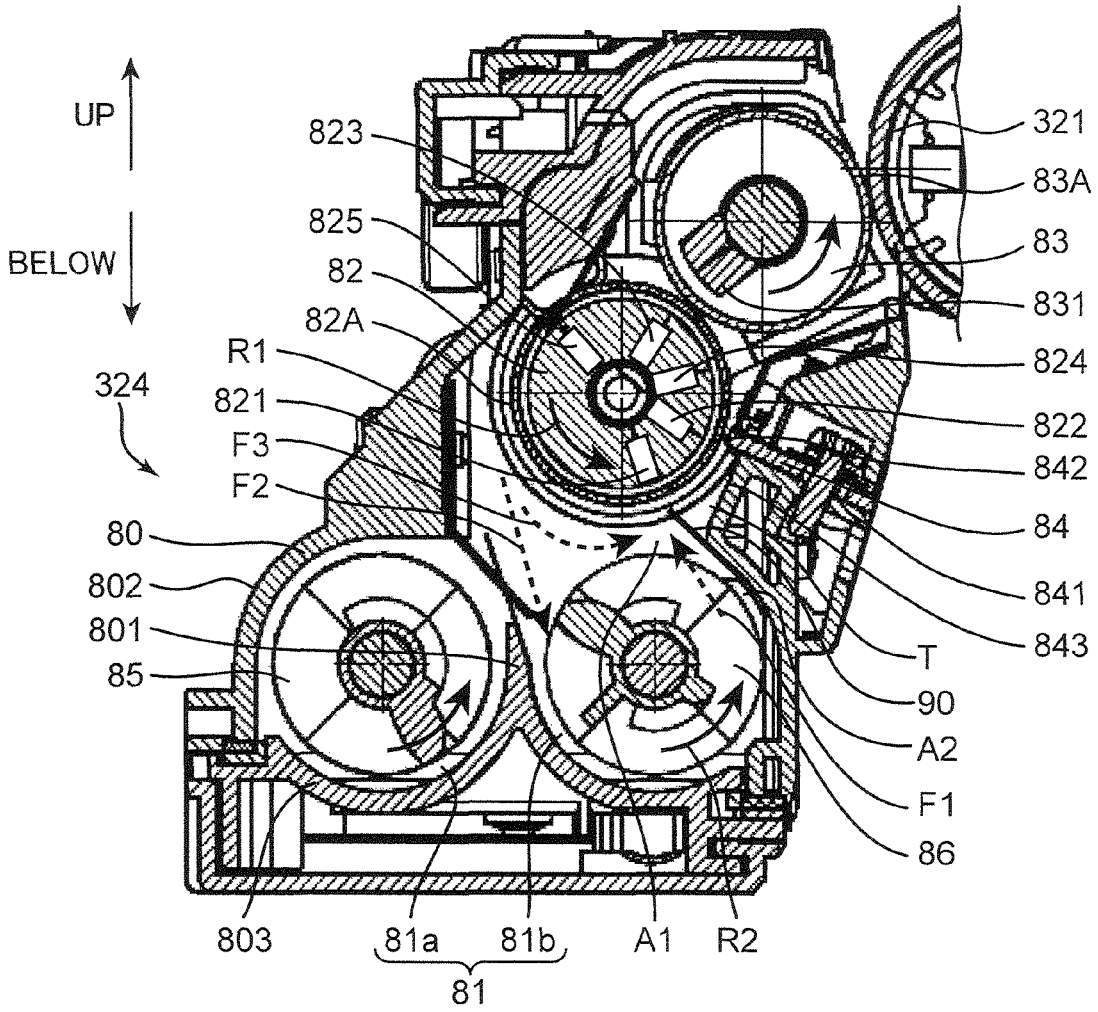
FIG. 2 is a sectional view of a developing device according to the one embodiment of the present disclosure.

Next, the developing device 324 of this embodiment is described in detail. FIG. 2 is a vertical sectional view schematically showing the internal structure of the developing device 324. The developing device 324 includes a development housing 80 (case) defining the internal space of the developing device 324. The development housing 80 includes a lid portion 802 for covering respective rollers housed therein from above and a bottom portion 803 connected to the lid portion 802 and forming a lower surface part of the development housing 80.

This development housing 80 includes a developer storing portion 81 which is a cavity for storing a developer containing a nonmagnetic toner and a magnetic carrier and can convey the developer while agitating it. In the development housing 80 are housed the magnetic roller 82 (developer bearing member) arranged above the developer storing portion 81, the developing roller 83 arranged to face the magnetic roller 82 at a position obliquely upward from the magnetic roller 82, a developer restricting blade (layer thickness restricting member) arranged to face the magnetic roller 82 and the screw feeders 85, 86 (agitating member) for agitating and conveying the developer.

The developer storing portion 81 includes two adjacent developer storage chambers 81*a*, 81*b* extending in a longitudinal direction of the developing device 324. Although the developer storage chambers 81*a*, 81*b* are partitioned from each other by a partition plate 801 integrally formed to the bottom portion 803 of the development housing 80 and extending in the longitudinal direction, they communicate with each other via communication paths 804, 805 at both ends in the longitudinal direction (see FIG. 3). The screw feeders 85, 86 are respectively housed in the developer storage chambers 81*a*, 81*b* and agitate and convey the developer by rotating about their shafts. The screw feeder 86 is arranged in the development housing 80 to face the magnetic roller 82, includes a shaft center 862 and a screw forming portion 861 arranged around the shaft center 862, and agitates and conveys the developer while rotating. The screw forming portion 861 has a spiral shape arranged around the shaft center 862. The screw feeders 85, 86 are driven and rotated by an unillustrated driving mechanism and developer conveying directions thereof are set to be opposite to each other along an axial direction. This causes the developer to be conveyed in a circulating manner while being agitated between the developer storage chambers 81*a*, 81*b* as shown by arrows D1, D2 in FIG. 3. By this agitation, the toner and the carrier are mixed, whereby the toner is, for example, negatively charged.

The magnetic roller 82 is arranged along the longitudinal direction of the developing device 324 and rotatable in a counterclockwise direction in FIG. 2. A fixed so-called magnet roll is arranged in the magnetic roller 82. The magnet roll has a plurality of magnetic poles and, in this embodiment, includes a pumping pole 821, a restricting pole 822, a main pole 823 and further a conveying pole 824 and a separating pole 825. The pumping pole 821 is facing the developer storing portion 81, the restricting pole 822 is facing the developer restricting blade and the main pole 823 is facing the developing roller 83. Further, the conveying pole 824 is arranged between the restricting pole 822 and the main pole 823 and the separating pole 825 is arranged downstream of the main pole 823 in the rotating direction of the magnetic roller 82.

The magnetic roller 82 magnetically pumps up (receives) the developer from the screw feeder 86 in the developer storage chamber 81*b* onto a circumferential surface 82A thereof by a magnetic force of the pumping pole 821 as shown by an arrow F1 of FIG. 2. The pumped-up developer is magnetically held as a developer layer (magnetic brush layer) on the circumferential surface 82A of the magnetic roller 82 and conveyed toward the developer restricting blade 84 according to the rotation of the magnetic roller 82. The developer restricting blade 84 is arranged upstream of the developing roller 83 in the rotating direction of the magnetic roller 82 and restricts the layer thickness of the developer layer magnetically adhering to the circumferential surface 82A of the magnetic roller 82.

The developer restricting blade 84 is a plate member made of a magnetic material and extending along the longitudinal direction of the magnetic roller 82 and is supported by a supporting member 841 fixed at an appropriate position of the development housing 80. Further, the developer restricting blade 84 has a restricting surface 842 (i.e. leading end surface of the developer restricting blade 84) which forms a restriction gap of a predetermined dimension between itself and the circumferential surface 82A of the magnetic roller 82. In this embodiment, the restriction gap is set at 0.3 mm.

The supporting member 841 is in the form of a rectangular column having a substantially trapezoidal cross-sectional shape and extending in a rotation axis direction of the magnetic roller 82. Further, the supporting member 841 has a facing surface 843 which is one surface of the supporting member 841 in a longitudinal direction, intersects with the developer restricting blade 84 and faces the magnetic roller 82. The facing surface 843 faces the rotational circumferential surface of the magnetic roller 82 with a gap wider than the restriction gap of the developer restricting blade 84. In this embodiment, the gap between the facing surface 843 and the magnetic roller 82 is set at at most 3.0 mm.

Here, in this embodiment, a sheet member 90 (flexible member) extending upward at a predetermined angle toward the circumferential surface of the magnetic roller 82 is arranged at a position upstream of the arrangement position of the developer restricting blade 84 in the rotating direction of the magnetic roller 82. The sheet member 90 is a flexible plate-like member and made of PET (polyethylene terephthalate) having a thickness of 100 microns in this embodiment. One end as a fixed end of the sheet member 90 is fixed to a lower surface part (surface intersecting with the facing surface 843) of the supporting member 841, and the other end as a free end extends toward the circumferential surface of the magnetic roller 82. The leading end (so-called free end) of the sheet member 90 is proximately arranged at a predetermined distance from the circumferential surface 82A of the magnetic roller 82 and comes into contact with a developer layer conveyed on the circumferential surface 82A.

The sheet member 90 and the supporting member 841 can be fixed by various methods. In this embodiment, an end surface of the sheet member 90 and the lower surface part of the supporting member 841 are bonded by a double-sided adhesive tape along the rotation axis direction of the magnetic roller 82. In addition, a method for screwing and fixing at a plurality of positions along the rotation axis direction of the magnetic roller 82 and the like can be, for example, adopted. The developer restricting blade 84, the facing surface 843 and the sheet member 90 form a space portion T (auxiliary developer storing portion) between themselves and the circumferential surface 82A of the magnetic roller 82. Particularly, the sheet member 90 forms a wall surface (also referred to as a bottom part) which is located on an upstream side of the auxiliary developer storing portion in the rotating direction of the magnetic roller and at a lower side in a gravitational direction.

In other words, the layer thickness restricting member 84 is fixed to an upper surface part of the supporting member 841 intersecting with the facing surface 843. Further, the sheet member 90 is fixed to the lower surface part of the supporting member 841 intersecting with the facing surface 843. The space portion T is defined by the layer thickness restricting member 84, the facing surface 843, the sheet member 90 and the circumferential surface of the magnetic roller 82.

A part of the developer layer adhering to the circumferential surface 82A of the magnetic roller 82 by the pumping pole 821 comes into contact with the sheet member 90 and the remaining part is conveyed into the space portion T while passing between the sheet member 90 and the magnetic roller 82. Further, in the space portion T, the developer is conveyed toward the developer restricting blade 84 while being circulated and retained.

The developer restricting blade 84 made of the magnetic material is magnetized by the restricting pole 822 of the magnetic roller 82. This causes a magnetic path to be formed between the restricting surface 842 of the developer restricting blade 84 and the restricting pole 822, i.e. in the restriction gap. When the developer is conveyed from the space portion T into the restriction gap according to the rotation of the magnetic roller 82, the layer thickness of the developer layer is restricted in the restriction gap. This causes a uniform developer layer having a predetermined thickness to be formed on the circumferential surface 82A.

The developing roller 83 is arranged to extend along the longitudinal direction of the developing device 324 and in parallel to the magnetic roller 82 and is rotatable in a counterclockwise direction in FIG. 2. The developing roller 83 has a circumferential surface 83A which receives the toner from the developer layer and carries a toner layer while rotating in contact with the developer layer held on the circumferential surface 82A of the magnetic roller 82. In the developing roller 83, a facing main pole 831 is arranged at a position facing the main pole 823 of the magnetic roller 82. The toner in the developer layer on the circumferential surface 82A moves to the circumferential surface 83A since a magnetic field is formed between the main pole 823 and the facing main pole 831 and a predetermined voltage is set between the circumferential surface 82A and the circumferential surface 83A (so-called developing portion). At the time of development in which a developing operation is performed, the toner on the circumferential surface 83A is supplied to the circumferential surface of the photoconductive drum 321. The developer on the magnetic roller 82 having passed through a facing portion facing the developing roller 83 is separated from the circumferential surface 82A by the separating pole 825, falls down to the developer storage chamber 81*b* located below in which the screw feeder 86 is housed, and is agitated again.

Note that the developing roller 83 and the magnetic roller 82 are driven and rotated by a drive source (not shown). A clearance of a predetermined dimension is formed between the circumferential surface 83A of the developing roller 83 and the circumferential surface 82A of the magnetic roller 82. The clearance is, for example, set at about 130 μm. The developing roller 83 is arranged to face the photoconductive drum 321 through an opening formed in the development housing 80, and a clearance of a predetermined dimension is also formed between the circumferential surface 83A and the circumferential surface of the photoconductive drum 321.

<Concerning Cause for Toner Density Distribution>

Figure 3:
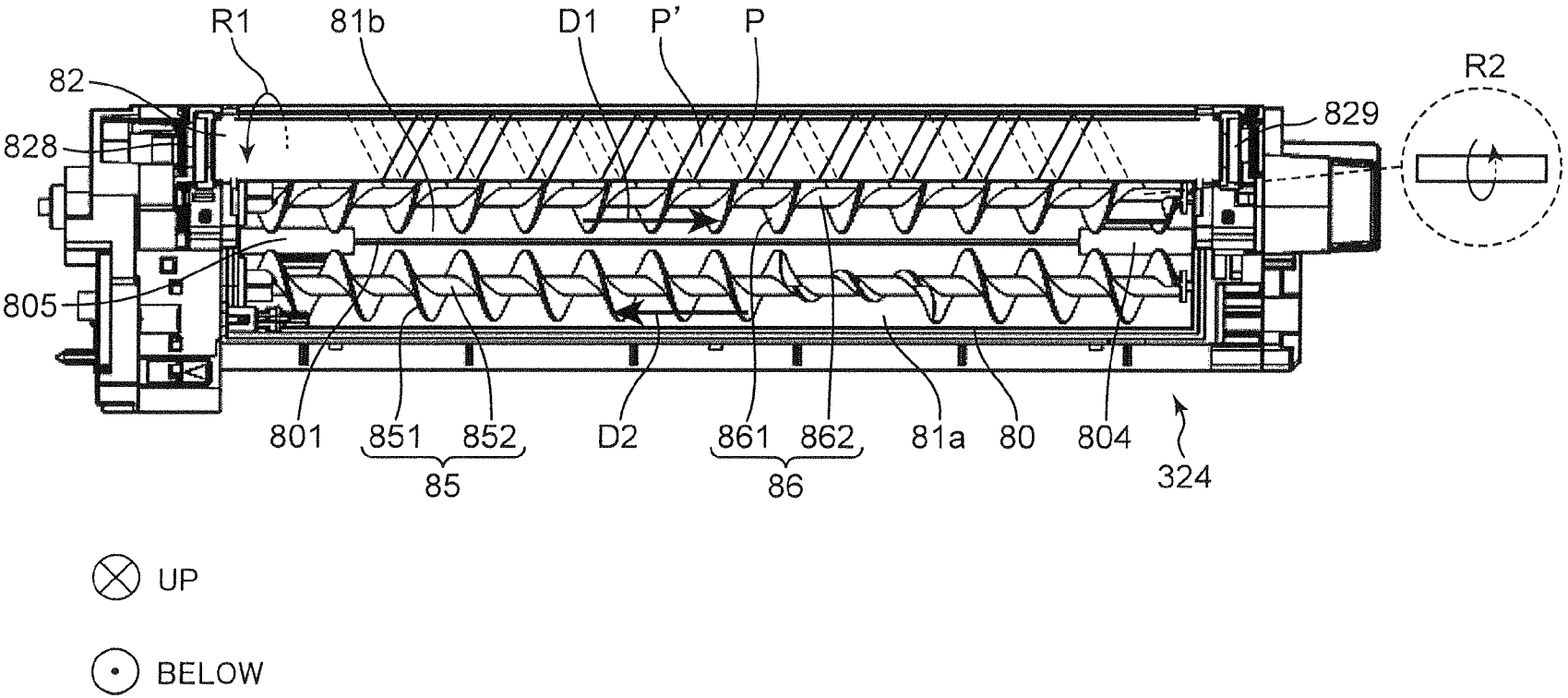
FIG. 3 is a view showing the internal structure of the developing device according to the one embodiment of the present disclosure, FIG. 4 are diagrams showing the action of a flexible member according to the embodiment of the present disclosure.

Next, a phenomenon in the developing device which occurs when the sheet member 90 according to this embodiment is not provided is described with reference to FIGS. 2 and 3. FIG. 3 is a view showing the internal structure of the developing device 324 in the longitudinal direction of the magnetic roller 82 from above. FIG. 3 shows a state where the lid portion 802 of the development housing 80 shown in FIG. 2 is removed and the screw feeder 86 is seen between the magnetic roller 82 and the screw feeder 85. Note that the developing roller 83 is not shown in FIG. 3.

In the development housing 80, the screw feeders 85, 86 substantially horizontally adjacent to each other convey the developer in opposite directions along the rotation axis direction of the magnetic roller 82 (arrows D1, D2 of FIG. 3). Further, developer conveying paths at ends of these screw feeders 85, 86 in the axial direction are allowed to communicate by the communication paths 804, 805 provided in the bottom portion 803 of the development housing 80, whereby a clockwise developer circulation path is formed as a whole.

The magnetic roller 82 is arranged at a first position (A1 of FIG. 2) to face the screw feeder 86 from above. The magnetic roller 82 rotates in a direction R1 in FIGS. 2 and 3 and the screw feeder 86 rotates in an opposite direction (direction R2) to the magnetic roller 82 at the first position. A part of the developer is supplied from the screw feeder 86 to the circumferential surface 82A of the magnetic roller 82 (arrow F1 of FIG. 2) and the remaining developer is conveyed and agitated in the axial direction (arrow D1 of FIG. 3). Further, after the movement of the toner to the developing roller 83, the developer separated from the circumferential surface 82A by the separating pole 825 (FIG. 2) of the magnetic roller 82 flows into the conveyance path of the screw feeder 86 again (arrow F2 of FIG. 2).

Here, a part of the toner is consumed by the developing roller 83 at the main pole 823 in accordance with an electrostatic latent image formed on the photoconductive drum 321. Accordingly, the above developer separated from the magnetic roller 82 and flowing to the screw feeder 86 again has a reduced ratio (T/C) of the toner to the carrier constituting the two-component developer. Thus, the developer separated from the magnetic roller 82 and the developer agitated and conveyed in the direction of the arrow D1 in the screw feeder 86 have different toner/carrier ratios (T/C).

However, if the amount of the developer in the developing device 324 is small, the separated developer falls down below the screw feeder 86 as shown by the arrow F2 of FIG. 2. Thereafter, this developer is sufficiently agitated together with the surrounding developer and then supplied to the magnetic roller 82 again after being conveyed to sink toward the bottom portion 803 of the development housing 80. Thus, partial non-uniformity of the toner/carrier ratio is unlikely to be problematic.

On the other hand, if the amount of the developer in the developing device 324 is large (e.g. 400 g) under use conditions of the developing device 324, this developer separated from the magnetic roller 82 cannot slip under the screw feeder 86 by the rotational force of the screw forming portion 861 of the screw feeder 86. Rather, this developer is pushed back upward and tends to adhere to the magnetic roller 82 again (arrow F3 of FIG. 2). Note that such a phenomenon becomes notable when the amount of the developer in the developer storing portion 81 largely varies in a mode of supplying not only the toner, but also the carrier depending on the use of the developing device, i.e. in a so-called trickle development mode.

The above re-adhering phenomenon of the separated developer to the magnetic roller 82 is attributable to the screw feeder 86. Parts where the re-adherence of the separated developer is notable are cyclically distributed on the magnetic roller 82 in conformity with the shape (spiral shape) of the screw forming portion 861 of the screw feeder 86. The cyclic distribution approximates to a line formed by projecting a trace of the outer rim of the screw forming portion 861 when the screw feeder 86 rotates on the facing surface (circumferential surface of the magnetic roller 82). As a result, the toner density is non-uniformly distributed on the magnetic roller 82.

In FIG. 3, dotted line parts P shown on the circumferential surface of the magnetic roller 82 represent a distribution of the re-adherence of the separated developer on the underside of the magnetic roller 82 (side facing the screw feeder 86), and the cycle and distribution shape thereof correspond to the shape of the outer rim (spiral shape) of the screw forming portion 861 of the facing screw feeder 86. That is, since the re-adherence of the separated developer is notable at positions of the circumferential surface 82A of the magnetic roller 82 facing the screw forming portion 861, the developer having a low T/C (toner density) is adhering. On the other hand, since a conveying force in a radial direction is small at positions corresponding to the shaft center 862 of the screw feeder 86, the separated developer is unlikely to re-adhere to the magnetic roller 82. Thus, the developer having slipped under the screw feeder 86, sufficiently agitated and having a high T/C is adhering to the circumferential surface 82A of the magnetic roller 82 (F1 of FIG. 2).

As just described, a distribution of the re-adhering developer corresponds to the projected shape of the trace of the outer rim of the screw forming portion 861 on the screw feeder 86 when the magnetic roller 82 and the screw feeder 86 rotate relative to each other on the circumferential surface of the magnetic roller 82. Note that solid line parts P' in FIG. 3 show a distribution when this re-adhering developer is conveyed toward the upper side of the circumferential surface 82A of the magnetic roller 82 according to the rotation of the magnetic roller 82.

Further, the developers having different T/C (toner densities) may have different fluidities. Accordingly, the above re-adhering developer distributed on the magnetic roller 82 and the developer supplied from below the screw feeder 86 and surrounding the re-adhering developer may cause unevenness in the amount of the developer adhering to the circumferential surface 82A of the magnetic roller 82. In other words, there may be a partial height difference of the developer layer on the circumferential surface 82A.

Such a variation of the T/C (toner density) and unevenness in the amount of the developer on the magnetic roller remain also on the developing roller 83 to which the toner moves from the magnetic roller 82 and in a toner image on the photoconductive drum 321, which results in an image defect.

<Concerning Sheet Member>

Here, in this embodiment, the sheet member 90 is arranged below the magnetic roller 82 and upstream of the developer restricting blade 84 in the rotating direction of the magnetic roller 82 to solve the above problem of re-adherence of the separated developer (production of the re-adhering developer). FIGS. 4 to 6 are diagrams showing the flow of the developer around the magnetic roller 82 when this sheet member 90 is provided. FIG. 4A shows the flow of the developer between the magnetic roller 82 and the screw feeder 86 when the sheet member 90 is not provided and FIG. 4B shows the flow of the developer when the sheet member 90 is provided.

In FIG. 4A, the magnetic roller 82 is rotated in the direction R1 and the screw feeder 86 is rotated in the direction R2. As described above, in a preferable flow of the developer, the developer separated from the magnetic roller 82 flows into the screw feeder 86 as shown by an arrow F2 in FIG. 4A and is agitated together with the other developer (arrow D1 in FIG. 3) being conveyed in the screw feeder 86. Thereafter, the agitated developer is supplied to the magnetic roller 82 by a magnetic force of the pumping pole 821 as shown by an arrow F1. On the other hand, if the amount of the developer in the developing device 324 is large, the separated developer re-adheres to the magnetic roller 82 without being sufficiently agitated as shown by an arrow F3.

Figure 4B:
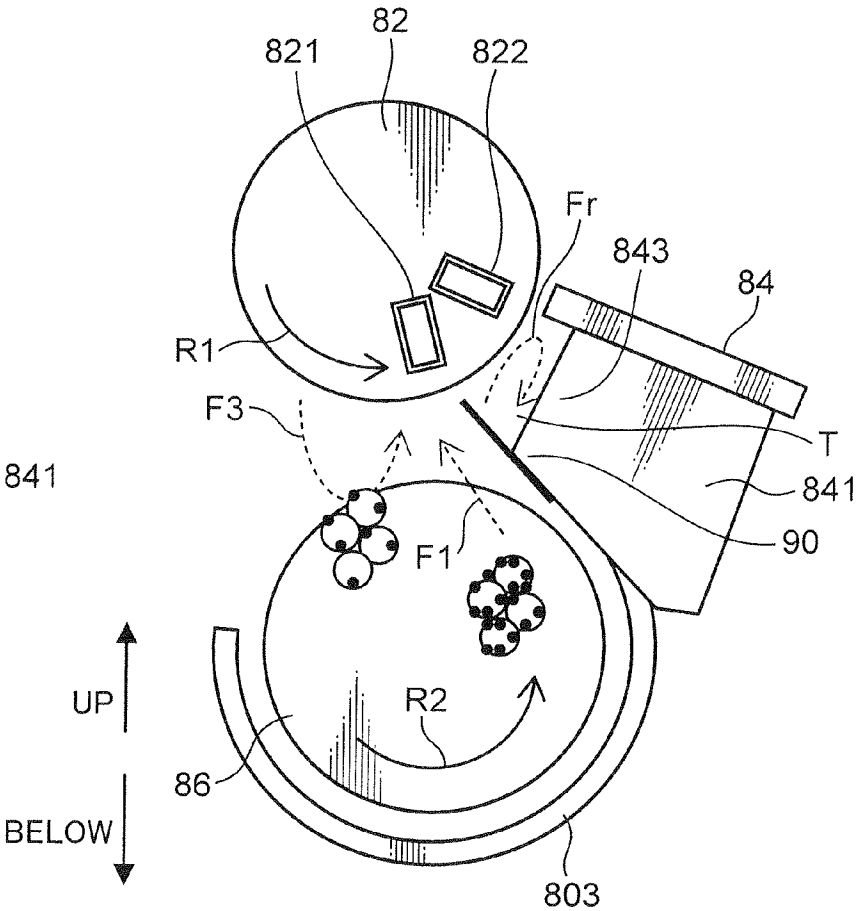
Figure 4A:
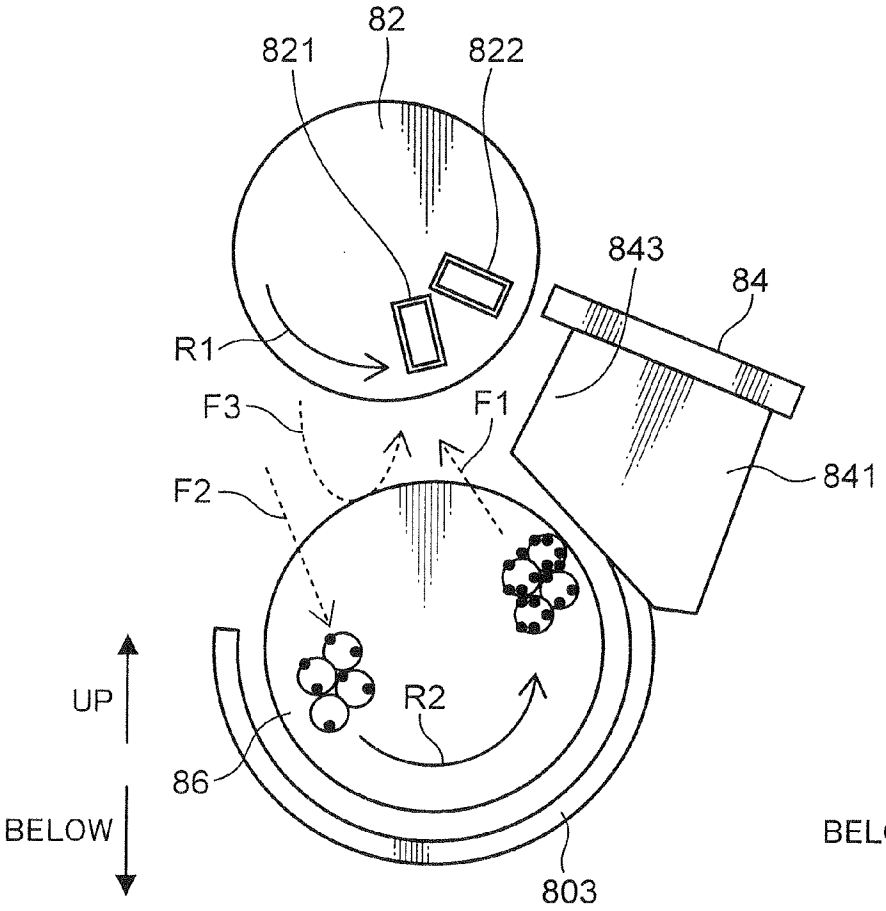
Figure 5B:
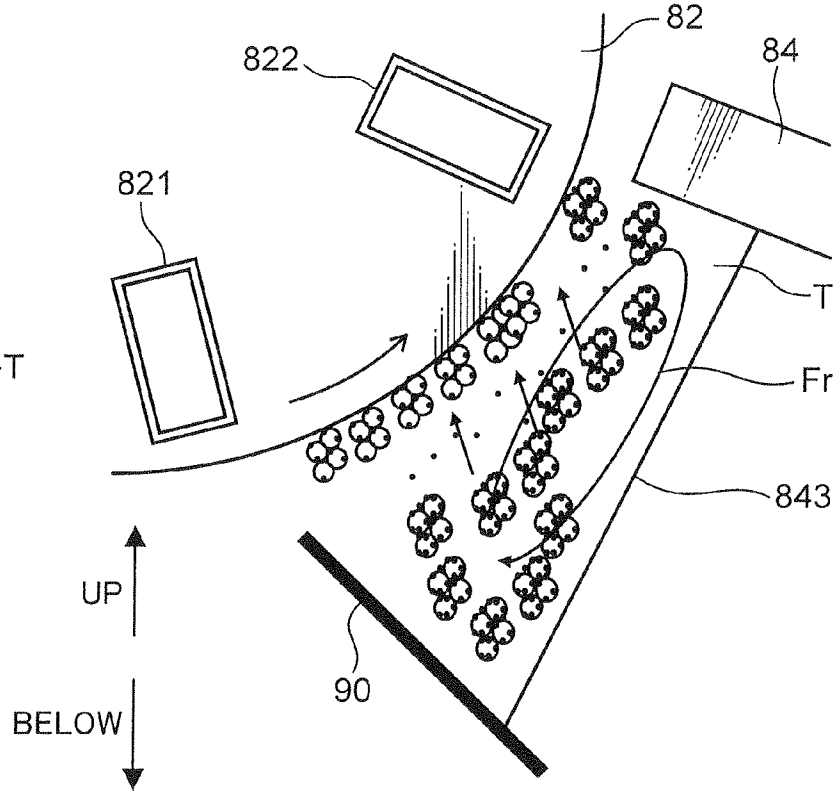
FIG. 5 are diagrams showing the action of the flexible member according to the embodiment of the present disclosure, and FIG. 6 are showing the action of the flexible member according to the embodiment of the present disclosure.

Contrary to this, in FIG. 4B, the sheet member 90 extends toward the circumferential surface of the magnetic roller downstream of the pumping pole 821 arranged in the magnetic roller 82 in the rotating direction of the magnetic roller 82. A leading end part of the sheet member 90 is arranged to come into contact with the developer layer (not shown) on the magnetic roller 82. Accordingly, even if the developers supplied onto the magnetic roller 82 by the flows of arrows F1, F3 are mixedly present in a cyclic manner in the rotation axis direction of the magnetic roller 82, the leading end part of the sheet member 90 has an effect of mixing these developer layers, thereby mitigating their cyclic distribution.

Figure 5A:
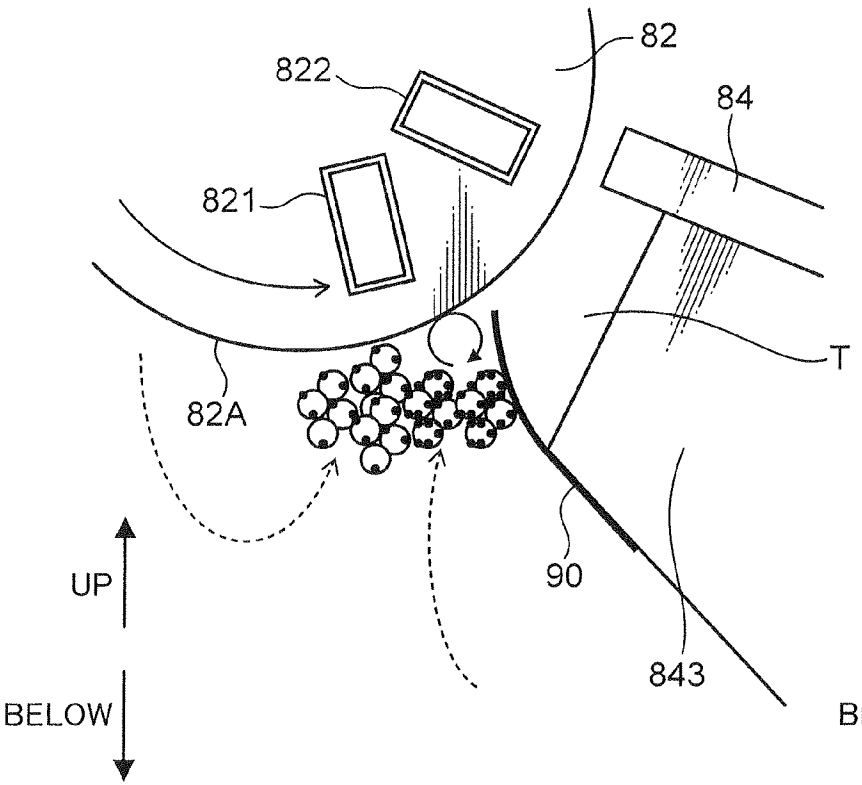
Figure 6B:
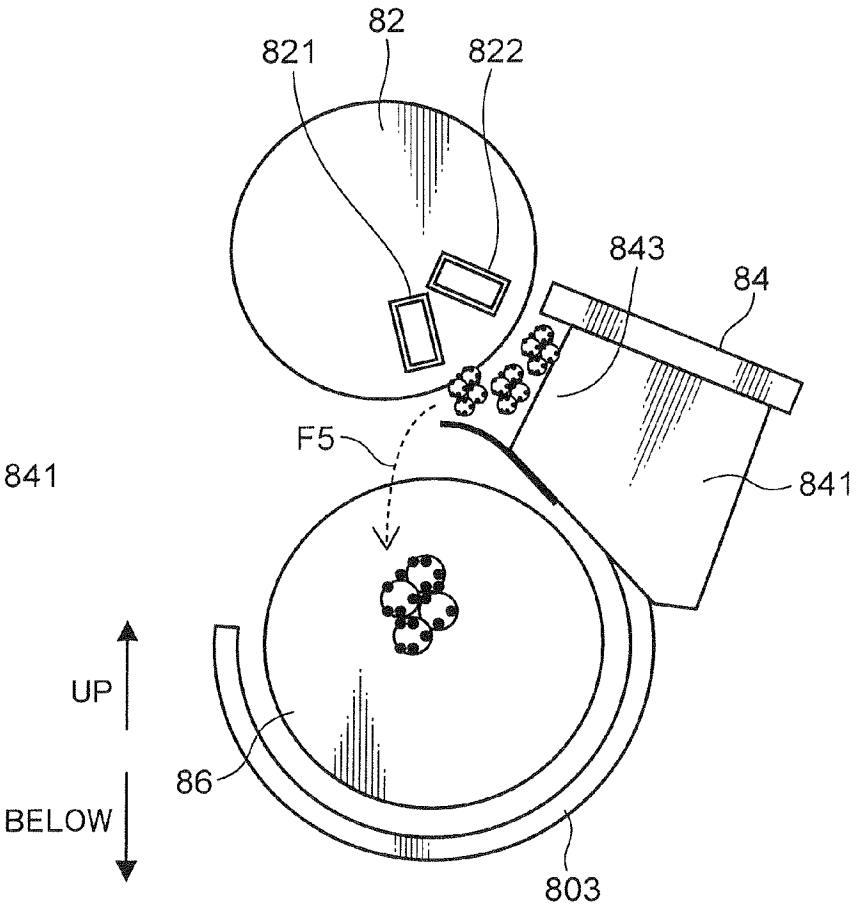

Here, the sheet member 90 is made of the PET material that is a flexible material. Thus, the leading end of the sheet member 90 is likely to be warped toward the downstream side in the rotating direction of the magnetic roller 82 by the rotational force of the magnetic roller 82 and the pressure of the developer being conveyed as shown in FIG. 5A. In a wedge-shaped space formed by this warped leading end part of the sheet member 90 and the circumferential surface 82A of the magnetic roller 82, the developer is likely to be retained as shown by an arrow of FIG. 5A. Thus, the respective developers supplied by the flows of arrows F1 and F3 (FIG. 4B) flow into the space portion T beyond the leading end part of the sheet member 90 after being agitated with each other in this wedge-shaped area. In this embodiment, the sheet member 90 extends toward the circumferential surface 82A of the magnetic roller 82 particularly at the position downstream of the pumping pole 821 fixedly arranged in the magnetic roller 82 in the rotating direction of the magnetic roller 82. Thus, the pumping-up of the developer by the pumping pole 821 and the agitation of the developer by the leading end part of the sheet member 90 are successively performed in the rotating direction of the magnetic roller 82. Therefore, the leading end part of the sheet member 90 is less likely to interfere with the pumping-up of the developer by the pumping pole 821.

Further, in this embodiment, the sheet member 90 extends toward the circumferential surface 82A of the magnetic roller 82 from a bottommost part of the facing surface 841 of the developer restricting blade 84. This sheet member 90 also serves as the wall surface part (also referred to as the bottom part) at the lower side in the gravitational direction of the space portion T arranged upstream of the developer restricting blade 84 in the rotating direction of the magnetic roller 82. The developer having flowed into the space portion T from between the leading end part of the sheet member 90 and the circumferential surface 82A of the magnetic roller 82 is moved to the developer restricting blade 84 by the conveyance force of the magnetic roller 82 and a part thereof is restricted by the side surface 845 of the developer restricting blade 84 to be scraped off. Thus, a circulating flow of the developer as shown by an arrow Fr in FIG. 5B is generated in the space portion T. The circulating flow of the developer generated in the space portion T has a function of giving a predetermined pressure to the developer being conveyed on the magnetic roller 82 and auxiliarly supplying toner particles to the surfaces of carrier particles in a part having a low toner density. Accordingly, even if the agitation by the leading end part of the aforementioned sheet member 90 is insufficient, the toner is supplied in the space portion T for a remaining variation of the toner density. Therefore, the layer is restricted by the developer restricting blade 84 with the toner density distribution further suppressed.

Figure 6A:
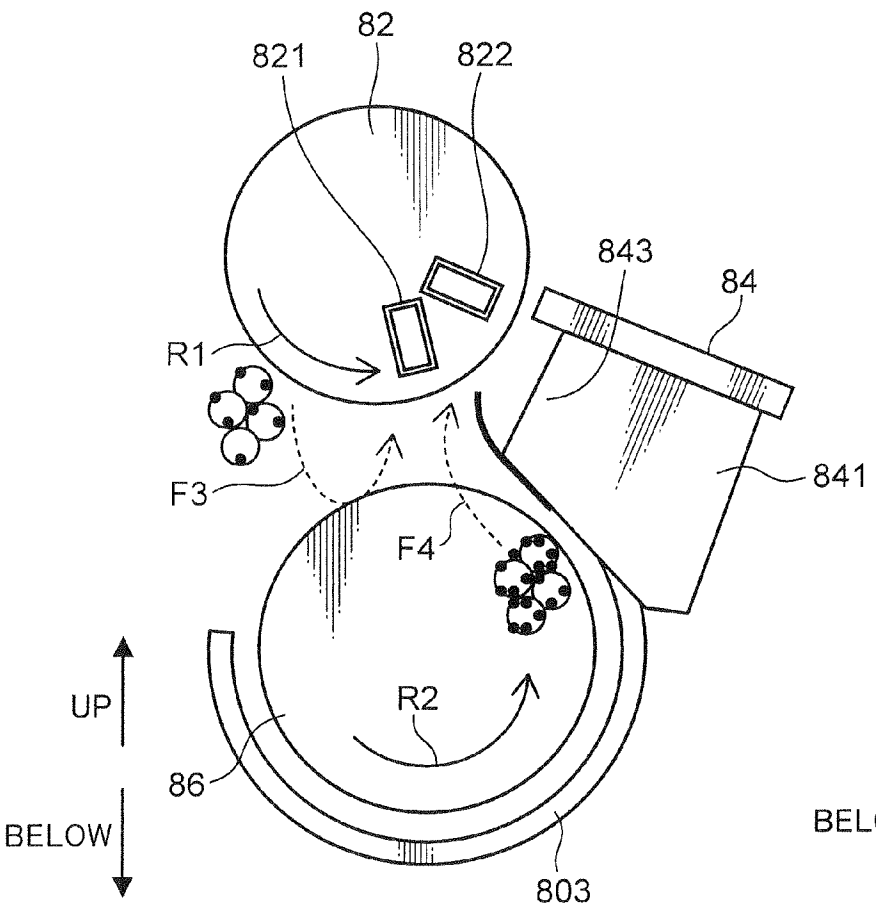

Here, if the amount of the developer circulating in the space portion T is small, a pressing force exerted downward from the space portion T to the sheet member 90 is small. Since being made of the flexible PET material in this case, the sheet member 90 is more likely to be warped upwardly by the rotational force of the magnetic roller 82 and the pressure of the developer being conveyed on the circumferential surface 82A (FIG. 6A). Thus, a gap between the leading end part of the sheet member 90 and the circumferential surface 82A of the magnetic roller 82 is enlarged to promote the inflow of the developer into the space portion T (arrow F4). That is, the sheet member 90 has a function of making the developer pumped up by the pumping pole 821 of the magnetic roller 82 more likely to flow into the space portion T when the amount of the developer circulating in the space portion T is small.

On the other hand, if the amount of the developer circulating in the space portion T is large, a pressing force exerted downward from the space portion T to the sheet member 90 is large. In this case, even if being subjected to the rotational force of the magnetic roller 82 and the pressure of the developer being conveyed on the circumferential surface 82A, the sheet member 90 is unlikely to be warped upwardly. Thus, the gap between the leading end part of the sheet member 90 and the circumferential surface 82A of the magnetic roller 82 is not enlarged, wherefore the amount of the developer flowing into the space portion T is maintained without being increased. That is, the sheet member 90 has a function of restricting the amount of the developer pumped up by the pumping pole 821 of the magnetic roller 82 and flowing into the space portion T when the amount of the developer circulating in the space portion T is large.

Further, if the amount of the developer circulating in the space portion T is large and the fluidity thereof is deteriorated, the sheet member 90 can be warped downwardly when the rotation of the magnetic roller 82 is stopped. Thus, a part of the developer in the space portion T falls down toward the screw feeder 86 to adjust the amount of the developer in the space portion T (arrow F5 of FIG. 6B).

As just described, the sheet member 90 in this embodiment is made of the flexible material and arranged to also serve as the wall surface part of the space portion T (auxiliary developer storing portion) at the upstream side in the rotating direction of the magnetic roller 82. Thus, the shape of the sheet member 90 and the posture thereof with respect to the magnetic roller 82 change according to the amount of the developer circulating in the space portion T. As a result, the amount of the developer flowing into the space portion T is effectively adjusted. Particularly, the sheet member 90 forms the bottom part at the lower side of the space portion T in the gravitational direction. Thus, the sheet member 90 is easily deformed and the gap, into which the developer flows, is easily adjusted according to the amount of the developer in the space portion T. Therefore, a necessary amount of the developer more easily flows into the space portion T according to the amount of the developer in the space portion T.

Further, in this embodiment, the sheet member 90 is arranged to face the screw feeder 86 at a second position A2 (FIG. 2) upstream of the first position A1 where the screw feeder 86 and the magnetic roller 82 face each other in the rotating direction of the screw feeder 86. More specifically, the sheet member 90 extends from the supporting member 841 along a tangential direction to a cylindrical trace formed by the rotation of the outer rim of the screw forming portion 861 of the screw feeder 86 at the second position A2 with respect to the screw feeder 86. Thus, a supply path for the developer from the screw feeder 86 to the magnetic roller 82 is changed and the amount of the developer being supplied is effectively adjusted by the aforementioned curvature of the sheet member 90. For example, if the amount of the developer in the space portion T suddenly decreases, the sheet member 90 is curved upwardly (FIG. 6A). Therefore, the supply path for the developer from the screw feeder 86 to the magnetic roller 82 is widened and the developer is quickly supplied. As a result, the amount of the developer in the space portion T is stabilized and the function of solving the toner density distribution on the magnetic roller 82 can be maintained.

As described above, according to the sheet member 90 of this embodiment, the developer conveyed on the magnetic roller 82 collides with the sheet member 90 to be agitated, whereby a variation of the toner density distributed in the axial direction is suppressed. Further, the developers stored and circulating in the space portion T, the bottom part of which is formed by the sheet member 90, are mixed with each other while giving a pressure to the developer on the magnetic roller 82. At this time, since the toner is supplied onto the magnetic roller 82 from the developer in the space portion T, the above variation of the toner density is further reduced. Furthermore, the shape of the sheet member 90 and the posture thereof with respect to the magnetic roller 82 change according to the amount of the developer circulating in the space portion T, thereby effectively adjusting the amount of the developer flowing into the space portion T.

As a result, even if the amount of the developer in the developing device 324 is large (e.g. 400 mg/mm2), it is possible to reduce the cyclic toner density distribution produced by the re-adherence of the separated developer onto the magnetic roller 82. Further, it is possible to effectively suppress an image defect caused by this cyclic toner density distribution.

Although the developing device according to the embodiment of the present disclosure has been described above, the present disclosure is not limited to this and, for example, the following modifications may be adopted.

(1) Although a plate-like member made of the PET material (resin material) is used as the sheet member 90 in the above embodiment, the sheet member 90 is not limited to this and may be made of a metallic material. Here, a nonmagnetic metallic material is preferably selected for the sheet member 90 so that no magnetic field is formed between the sheet member 90 and the magnetic poles included in the magnetic roller 82. In this case, the agitation of the developer by the leading end part of the sheet member 90 and the inflow of the developer into the space portion T (auxiliary developer storing portion) are unlikely to be interfered with by the magnetic field and a variation of the toner density on the magnetic roller 82 can be effectively suppressed.

(2) In the above embodiment, the sheet member 90 also serves as the wall surface part (bottom part) at the lower side in the gravitational direction of the space portion T arranged upstream of the developer restricting blade 84 in the rotating direction of the magnetic roller 82. The arrangement of the sheet member 90 is not limited to this. As long as the sheet member 90 forms a wall surface on the upstream side of the space portion T in the rotating direction of the magnetic roller 82, that wall surface may be a side wall. A load the sheet member 90 receives from the developer in the space portion T is less when the sheet member 90 forms the side wall of the space portion T than when the sheet member 90 forms the bottom part of the space portion T. However, even in this case, the sheet member 90 can be curved toward the downstream side in the rotating direction of the magnetic roller 82 by the rotational force of the magnetic roller 82. Therefore, the developer is agitated by the leading end part of the sheet member 90 and the toner is supplied onto the magnetic roller from the developer in the space portion T to reduce a variation of the toner density on the magnetic roller 82.

EXAMPLES

Examples in which the distribution of the re-adhering developer on the magnetic roller 82 was mitigated by the sheet member 90 according to the above embodiment and screw unevenness in print image quality was effectively improved are described next.

Note that imaging was performed under the following data and conditions in Examples and Comparative Examples.

<Apparatus Conditions>

Image forming apparatus: TASKalfa 5550ci produced by Kyocera Mita

Photoconductive drum: diameter ϕ of 30 mm, circumferential speed of 300 mm/sec, surface potential (dark potential) of 300 V, light potential of 10 V Rotary sleeve of developing roller: made of aluminum, diameter ϕ of 20 mm, circumferential speed of 450 mm/sec Rotary sleeve of magnetic roller: made of aluminum, diameter ϕ of 20 mm, circumferential speed of 675 mm/sec Toner average particle diameter: 6.8 μm Carrier average particle diameter: 35 μm Toner/carrier weight ratio: 11%

Shortest distance between the surfaces of the magnetic roller 82 and the developing roller 83: 350 μm Shortest distance between the surfaces of the developing roller 83 and the photoconductive drum 321: 150 μm Developing roller applied voltages: dc voltage Vdc2=300 V, peak-to-peak ac voltage Vpp=1.6 kV, frequency f=2.7 kHz, duty ratio=50%

Magnetic roller applied voltages: dc voltage Vdc1=400 V, peak-to-peak ac voltage (having the same cycle as, but an opposite phase to the developing roller applied voltage Vpp) Vpp=2.8 kV, frequency f=2.7 kHz, duty ratio=70%

<Sheet Member 90>

Example 1

Includes the following sheet member 90

Thickness of the sheet member 90: 100 μm

Material of the sheet member 90: PET

Free end length (projecting amount from the supporting member 841) of the sheet member 90: 3.0 mm Distance between the magnetic roller 82 and the leading end part of the sheet member: 1.5 mm

Example 2

Includes the following sheet member 90

Thickness of the sheet member 90: 1 mm

Material of the sheet member 90: aluminum plate

Free end length (projecting amount from the supporting member 841) of the sheet member 90: 3.0 mm Distance between the magnetic roller 82 and the leading end part of the sheet member: 1.5 mm

Example 3

Includes the following sheet member 90

Thickness of the sheet member 90: 100 μm

Material of the sheet member 90: magnetic stainless steel (SUS403)

Free end length (projecting amount from the supporting member 841) of the sheet member 90: 3.0 mm Distance between the magnetic roller 82 and the leading end part of the sheet member: 1.5 mm

Comparative Example 1

Includes no sheet member 90

Comparative Example 2

Includes no sheet member 90, but includes a compressing member arranged to face the screw feeder 86 and forming a developer compressing portion.

TABLE 1

| Amount of Developer | Example 1 | Example 2 | Example 3 | Comparative Example 1 | Comparative Example 2 |
|---|---|---|---|---|---|
| 300 | ○ | ○ | Δ | x | ○ |
| 325 | ○ | ○ | ○ | ○ | ○ |
| 350 | ○ | ○ | ○ | ○ | ○ |
| 375 | ○ | ○ | ○ | x | x |
| 400 | ○ | ○ | Δ | x | x |

Table 1 shows an evaluation result of screw unevenness obtained by visually evaluating unevenness appearing due to the screw shape of the screw feeder 86 (screw unevenness) in forming a high-density image on the entire surface of an A3 print. ○ indicates no appearance of screw unevenness and Δ indicates acceptable appearance of screw unevenness and x indicates notable appearance of screw unevenness. In any one of these, whether or not screw unevenness appeared was evaluated while the amount of the developer in the developing device 324 was changed.

It is confirmed that, in Examples 1 and 2 shown in Table 1, the occurrence of screw unevenness is effectively prevented even if the amount of the developer in the developing device 324 is large (375 to 400 g) as compared with Comparative Example 1. Further, in Example 3 using the magnetic metallic material, the inflow of the developer into the space portion T is thought to be restricted since a magnetic field is formed between the leading end of the sheet member 90 and the pumping pole 821. However, it is understood that screw unevenness is improved under the condition that the amount of the developer is 375 g since the leading end part has an agitation effect for the developer layer. On the other hand, in Comparative Example 2 using the compressing member, an effect under the condition that the amount of the developer on the magnetic roller 82 is small (300 mg/cm$^2$) is seen, but no improvement is seen under the condition that the amount of the developer is large.

As described above, by adopting the sheet member 90, the occurrence of screw unevenness is effectively prevented by the agitation effect of the sheet member 90 and the toner supply from the space portion T (auxiliary developer storing portion) even in a state where the amount of the developer in the developing device 324 is large (375 to 400 g).

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developing device, comprising:

a case for housing a developer;

an agitating member arranged in the case, the agitating member including a shaft center and a screw forming portion arranged around the shaft center and configured to agitate and convey the developer while rotating;

a magnetic roller arranged in the case to face the agitating member, the magnetic roller including a rotary shaft and a plurality of magnetic poles to carry the developer on a circumferential surface of the magnetic roller, the magnetic poles successively moving into positions to face the agitating member and the magnetic pole that faces the agitating member defining a pumping pole that pumps up the developer from the agitating member to the circumferential surface of the magnetic roller;

a layer thickness restricting member arranged to face the magnetic roller and configured to restrict the layer thickness of the developer supplied from the agitating member to the magnetic roller to a predetermined thickness;

a plate-like flexible member facing the layer thickness restricting member along a rotation axis direction of the magnetic roller and extending toward the circumferential surface of the magnetic roller at a side upstream of the layer thickness restricting member in a rotating direction of the magnetic roller, the flexible member extending toward a position on the circumferential surface of the magnetic roller downstream of the pumping pole in the rotating direction of the magnetic roller; and an auxiliary developer storing portion arranged along the rotation axis direction of the magnetic roller to face the circumferential surface of the magnetic roller between the layer thickness restricting member and the flexible member; wherein the plate-like flexible member forms a wall surface on an upstream side of the auxiliary developer storing portion in the rotating direction of the magnetic roller along the rotation axis direction of the magnetic roller.

2. A developing device according to claim 1, wherein the layer thickness restricting member is arranged above the flexible member; and the flexible member forms a bottom part of the auxiliary developer storing portion.

3. A developing device according to claim 1, wherein:

the flexible member is made of a nonmagnetic material.

4. A developing device according to claim 1, wherein:

the magnetic roller and the agitating member are most proximate to and facing each other and rotated in opposite directions at a predetermined first position; and the flexible member is arranged to face the agitating member at a second position located upstream of the first position in a rotating direction of the agitating member and extends toward the circumferential surface of the magnetic roller along a tangential direction of a cylindrical trace of the outer rim of the screw forming portion at the second position.

5. A developing device according to claim 1, further comprising a supporting member with a facing surface arranged to face the magnetic roller with a clearance formed therebetween, wherein:

the layer thickness restricting member is fixed to an upper surface part of the supporting member intersecting with the facing surface;

the flexible member is fixed to a lower surface part of the supporting member intersecting with the facing surface; and the auxiliary developer storing portion is defined by the layer thickness restricting member, the facing surface, the flexible member and the circumferential surface of the magnetic roller.

6. An image forming apparatus, comprising:

a developing device; and an image bearing member on a surface of which an electrostatic latent image is to be formed and developed into a developer image by a developer supplied from the developing device; wherein the developing device includes:

a case for housing a developer, an agitating member arranged in the case, the agitating member including a shaft center and a screw forming portion arranged around the shaft center and configured to agitate and convey the developer while rotating, a magnetic roller arranged in the case to face the agitating member, the magnetic roller including a rotary shaft and a plurality of magnetic poles to carry the developer on a circumferential surface of the magnetic roller, the magnetic poles successively moving into positions to face the agitating member and the magnetic pole that faces the agitating member defining a pumping pole that pumps up the developer from the agitating member to the circumferential surface of the magnetic roller, a layer thickness restricting member arranged to face the magnetic roller and configured to restrict the layer thickness of the developer supplied from the agitating member to the magnetic roller to a predetermined thickness, a plate-like flexible member facing the layer thickness restricting member along a rotation axis direction of the magnetic roller and extending toward the circumferential surface of the magnetic roller at a side upstream of the layer thickness restricting member in a rotating direction of the magnetic roller, the flexible member extending toward a position on the circumferential surface of the magnetic roller downstream of the pumping pole in the rotating direction of the magnetic roller; and an auxiliary developer storing portion arranged along the rotation axis direction of the magnetic roller to face the circumferential surface of the magnetic roller between the layer thickness restricting member and the flexible member; wherein the plate-like flexible member forms a wall surface on an upstream side of the auxiliary developer storing portion in the rotating direction of the magnetic roller along the rotation axis direction of the magnetic roller.

7. An image forming apparatus according to claim 6, wherein the layer thickness restricting member is arranged above the flexible member; and the flexible member forms a bottom part of the auxiliary developer storing portion.

8. An image forming apparatus according to claim 6, wherein:

the flexible member is made of a nonmagnetic material.

9. An image forming apparatus according to claim 6, wherein:

the magnetic roller and the agitating member are most proximate to and facing each other and rotated in opposite directions at a predetermined first position; and the flexible member is arranged to face the agitating member at a second position located upstream of the first position in a rotating direction of the agitating member and extends toward the circumferential surface of the magnetic roller along a tangential direction of a cylindrical trace of the outer rim of the screw forming portion at the second position.

10. An image forming apparatus according to claim 6, further comprising a supporting member with a facing surface arranged to face the magnetic roller with a clearance formed therebetween, wherein:

the layer thickness restricting member is fixed to an upper surface part of the supporting member intersecting with the facing surface;

the flexible member is fixed to a lower surface part of the supporting member intersecting with the facing surface; and the auxiliary developer storing portion is defined by the layer thickness restricting member, the facing surface, the flexible member and the circumferential surface of the magnetic roller.

11. A developing device, comprising:

a case for housing a developer;

a magnetic roller arranged in the case, including a rotary shaft and configured to magnetically carry the developer on a circumferential surface by rotating about the rotary shaft;

an agitating member arranged to face the magnetic roller in the case, including a shaft center and a screw forming portion arranged around the shaft center and configured to agitate and convey the developer while rotating;

a layer thickness restricting member arranged to face the magnetic roller and configured to restrict the layer thickness of the developer supplied from the agitating member to the magnetic roller to a predetermined thickness;

an auxiliary developer storing portion arranged along a rotation axis direction of the magnetic roller to face the circumferential surface of the magnetic roller at a side upstream of the layer thickness restricting member in a rotating direction of the magnetic roller;

a plate-like flexible member extending toward the circumferential surface of the magnetic roller and forming a wall surface on an upstream side of the auxiliary developer storing portion in the rotating direction of the magnetic roller; and a supporting member with a facing surface arranged to face the magnetic roller with a clearance formed therebetween, wherein:

the layer thickness restricting member is fixed to an upper surface part of the supporting member intersecting with the facing surface;

the flexible member is fixed to a lower surface part of the supporting member intersecting with the facing surface; and the auxiliary developer storing portion is defined by the layer thickness restricting member, the facing surface, the flexible member and the circumferential surface of the magnetic roller.

* * * * *